US006058992A

United States Patent [19]

Stager et al.

[11] Patent Number: 6,058,992

[45] Date of Patent: May 9, 2000

[54] METHOD AND APPARATUS FOR PROFILING A LOG

[75] Inventors: Bradley R. Stager, Beaverton; John S. Luecke, Milwaukie, both of Oreg.

[73] Assignee: Key Knife, Inc., Tualatin, Oreg.

[21] Appl. No.: 09/327,810

[22] Filed: Jun. 8, 1999

[51] Int. Cl.[7] ..... B27L 11/00; B27G 13/00

[52] U.S. Cl. ..... 144/373; 144/222; 144/223; 144/235

[58] Field of Search ..... 144/43, 44, 218, 144/222, 231, 235, 236, 237, 220, 228, 373

[56] References Cited

U.S. PATENT DOCUMENTS

| | | | |
|---|---|---|---|
| 1,222,871 | 4/1917 | Jesseph | 144/222 |
| 3,780,778 | 12/1973 | Chapman | 144/223 |
| 5,617,908 | 4/1997 | Toogood | 144/235 |
| 5,709,255 | 1/1998 | Toogood | 144/220 |
| 5,816,301 | 10/1998 | Stager | 144/220 |

*Primary Examiner*—W. Donald Bray
*Attorney, Agent, or Firm*—Birdwell & Janke, LLP

[57] ABSTRACT

A method and apparatus for profiling a log. In a profiler having first and second knives disposed on a rotating disc, a mounting member is adapted to mountably receive both the first and second knives so that each blade has a point on its cutting edge that is proximate a point that is on the cutting edge of the other knives. Preferably, the points are end most points and abut one another.

6 Claims, 5 Drawing Sheets

METHOD AND APPARATUS FOR PROFILING A LOG

BACKGROUND OF THE INVENTION

The present invention relates to a method and apparatus for profiling a log, particularly for cutting a reentrant corner in the log that extends along the log.

To process logs into standard lumber, the logs are first slabbed on one to four sides. To avoid waste and, because the cross-section of the log is generally round, this processing intentionally leaves four rounded corners. Referring first to FIGS. 1A and 1B depicting, respectively, the cross-section of the log before and after being slabbed on four sides and then turning to FIG. 1C, the rounded corners are removed by cutting into the log along its longitudinal axis corresponding reentrant corners "C." This squares portions of the log, indicated in the Figure as "A", that are located between the contours of adjacent corners so that the portions are configured to be cut into pieces of standard lumber. Forming the corners C is typically referred to as "profiling" and an apparatus adapted for this purpose is typically referred to as a "profiler."

An example of a prior art profiler is shown in FIG. 2. First and second knives 2 and 4, which are identical, are disposed on the circumference of a rotating disc 6. A slabbed log 8 having an elongate axis "L" is fed toward the disc along a circumferential direction "d." The cutting edge of the first knife is oriented parallel to the axis of rotation of the disc and the cutting edge of the second knife is oriented in a plane of rotation of the disc. Referring back to FIG. 1C, the first knife cuts a first leg "11" of a particular reentrant corner C and the second knife cuts a perpendicular, second leg "12" of the reentrant corner, wherein the legs 11 and 12 meet at a region of intersection "c1" of the corner C. It should be understood that the legs "11" and "12" are the visible portions of planar surfaces extending along the longitudinal axis of the log.

Another example of a prior art profiler replaces the second knife with a sequence of cutting teeth disposed around the periphery of the disc, such as the teeth of a saw blade.

In both of these profilers, the first and second knives are disposed so that the first knife meets the log at a different time than does the second knife. Because there is relative movement between the disc and the log, this time difference provides an opportunity for the two cuts to fail to intersect precisely at the same corner region c1 and thereby fail to form a clean or smooth corner C. In particular, there often results, running longitudinally along the corner C, "feathers" or slivers of wood partially but not completely removed from the log, or other unevenness in the surface texture of the corner. This result is often aggravated further as wear occurs in the apparatus.

Accordingly, there is a need for a method and apparatus for profiling a log that provides for the formation of smoother surfaces in corners cut thereby and for maintaining this capability despite wear in the apparatus.

SUMMARY OF THE INVENTION

A method and apparatus for profiling a log according to the present invention solves the aforementioned problems and meets the aforementioned needs by providing in a profiler having first and second knives disposed on a rotating disc, wherein the first and second knives have respective cutting edges defining an angle therebetween that is typically but not necessarily 90 degrees, a mounting member that is adapted to mountably receive both the first and second knives so that each blade has a point on its cutting edge that is proximate a point that is on the cutting edge of the other knife. Preferably, the points of the cutting edges that are proximate are the ends of the cutting edges and, preferably, the proximity is such that the points abut one another.

Therefore, it is a principal object of the present invention to provide a novel and improved method and apparatus for profiling a log or other elongate article.

It is another object of the present invention to provide such a method and apparatus that provides for the formation of smoother surfaces in corners cut thereby.

It is still another object of the present invention to provide such a method and apparatus that provides for maintaining the aforementioned capability despite wear in the apparatus.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1A:
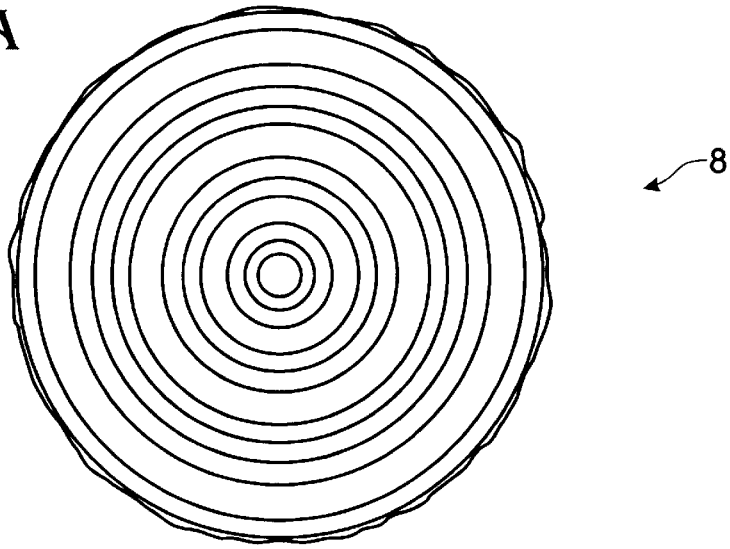
FIG. 1A is a cross-section of a log.
Figure 1B:
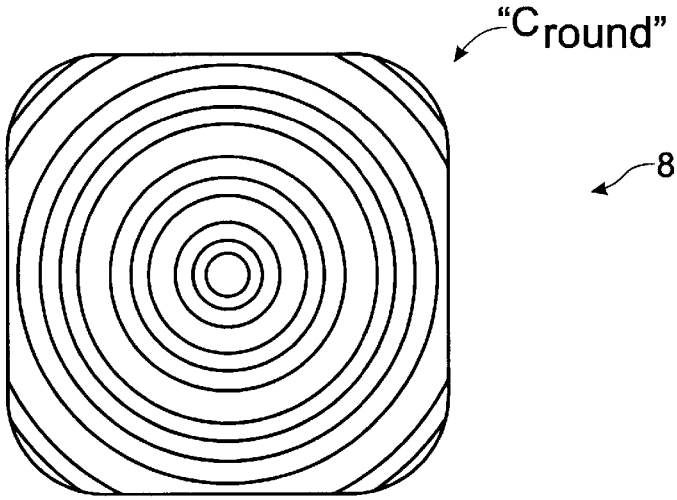
FIG. 1B is a cross-section of the log of FIG. 1A after having been slabbed.
Figure 1C:
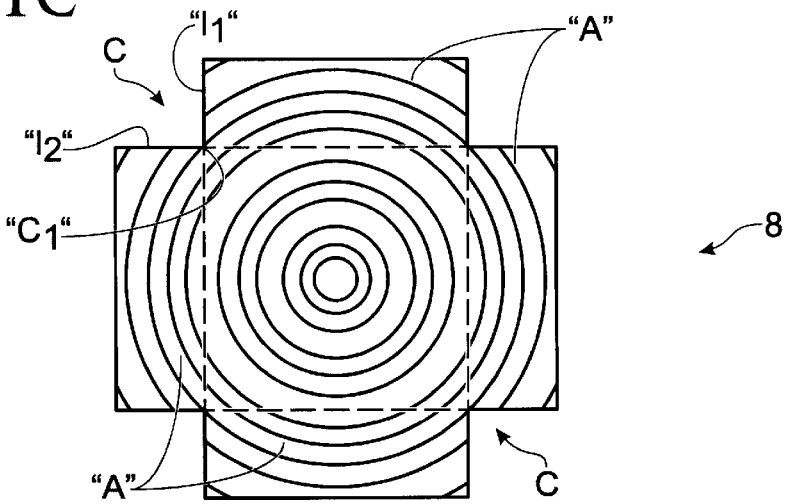
FIG. 1C is a cross-section of the log of FIG. 1B after having been profiled.
Figure 3:
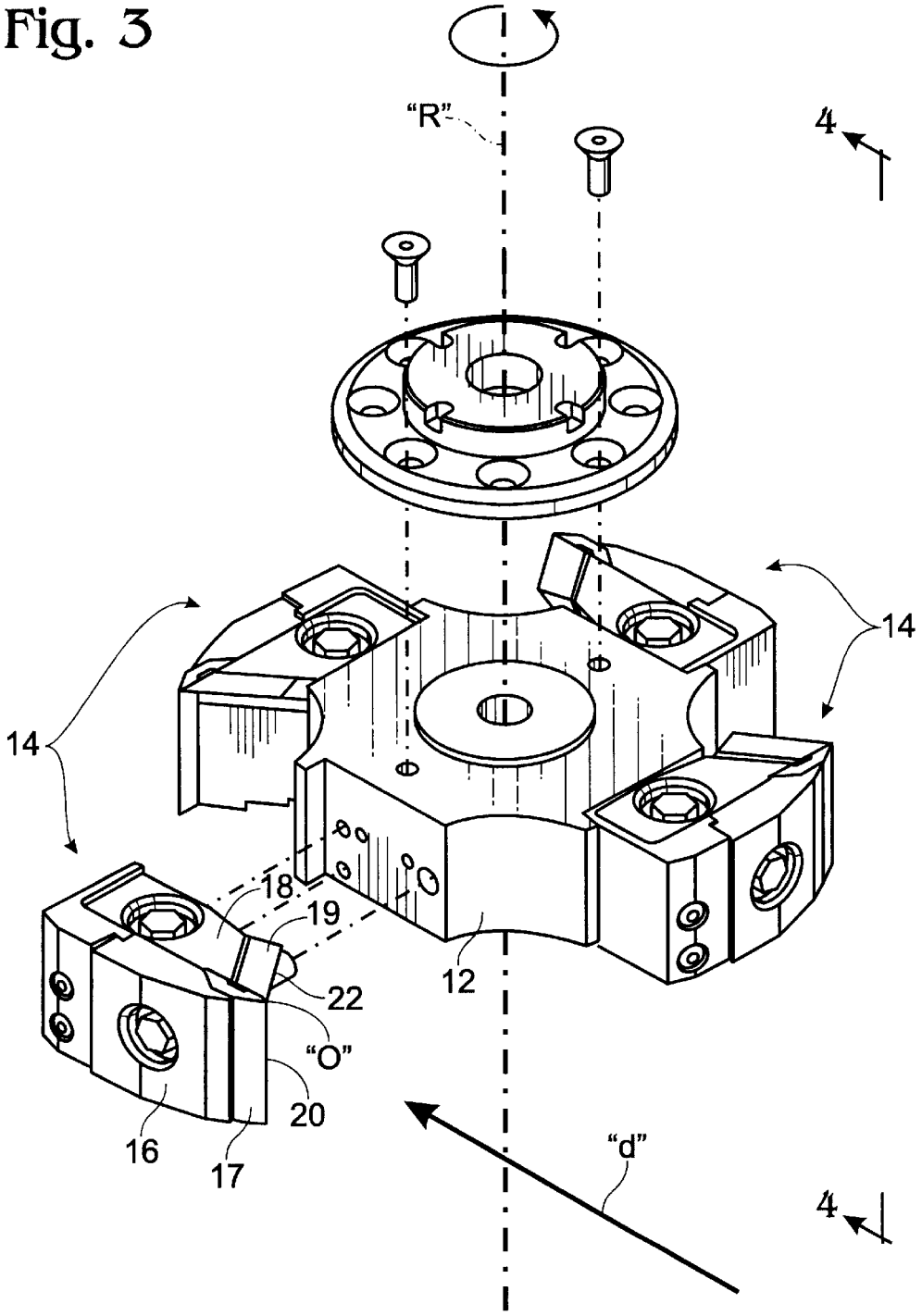
FIG. 3 is a partially exploded view of a profiling apparatus according to the present invention, showing a single rotor and a preferred mounting member.
Figure 4:
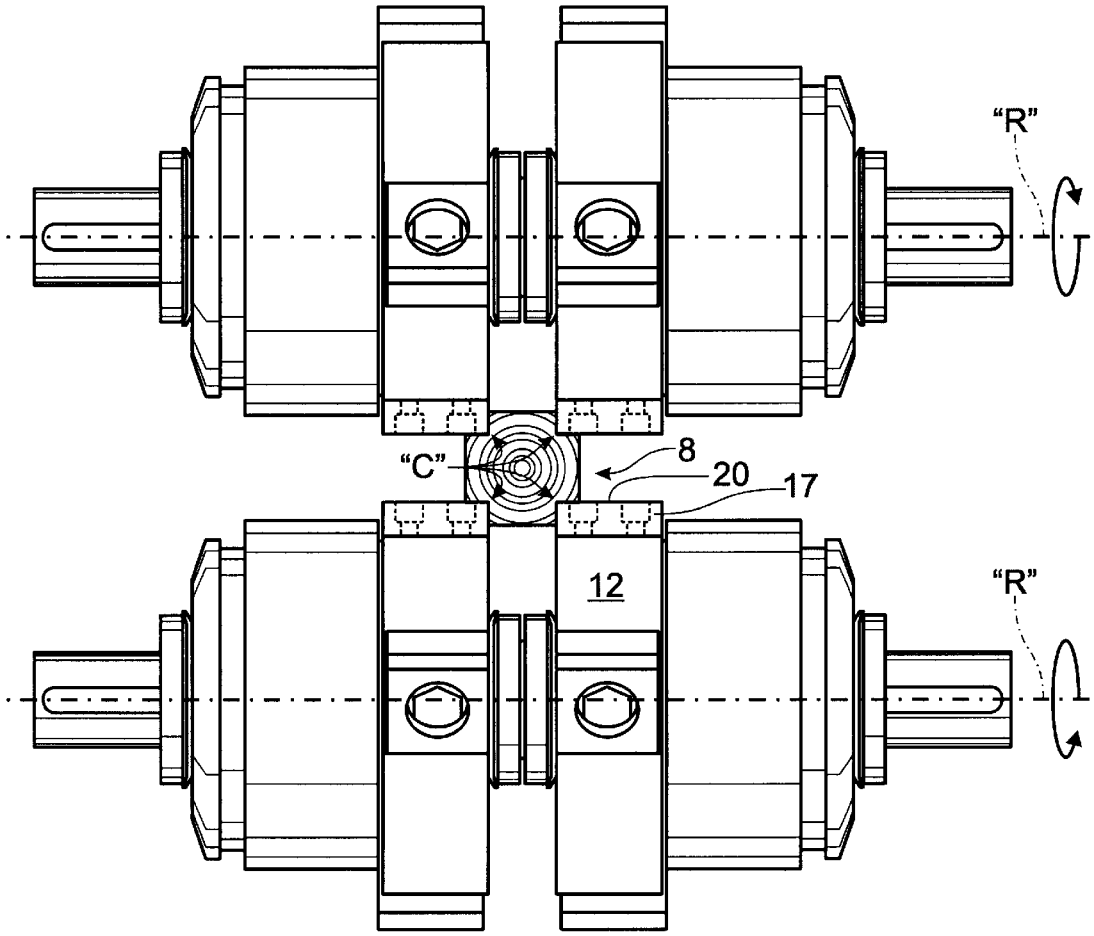
FIG. 4 is a side elevation of the profiling apparatus of FIG. 3, taken along a line 4—4 thereof, showing four rotors.

A profiling apparatus 10 according to the present invention is shown in FIGS. 3 and 4. The profiling apparatus is particularly adapted for profiling a log; however, it may be employed for profiling any elongate article. The term "profiling" means fundamentally to alter the shape of the article for some productive purpose. Referring back to FIGS. 1B and 1C, typically, this involves altering an elongate form such as the rounded corner "Cround" of a slabbed log into an elongate, reentrant, square corner "C." This configures the material indicated in FIG. 1C as "A" which lies between the contours of neighboring corners C into an orthorhombic configuration, or "squares" the material. It should be borne in mind throughout that other reentrant shapes could be formed, or corners could be formed having other angles varying from 90 degrees, where that is desirable, and the operation could be performed on elongate articles other than logs without departing from the principles of the invention.

Figure 2:
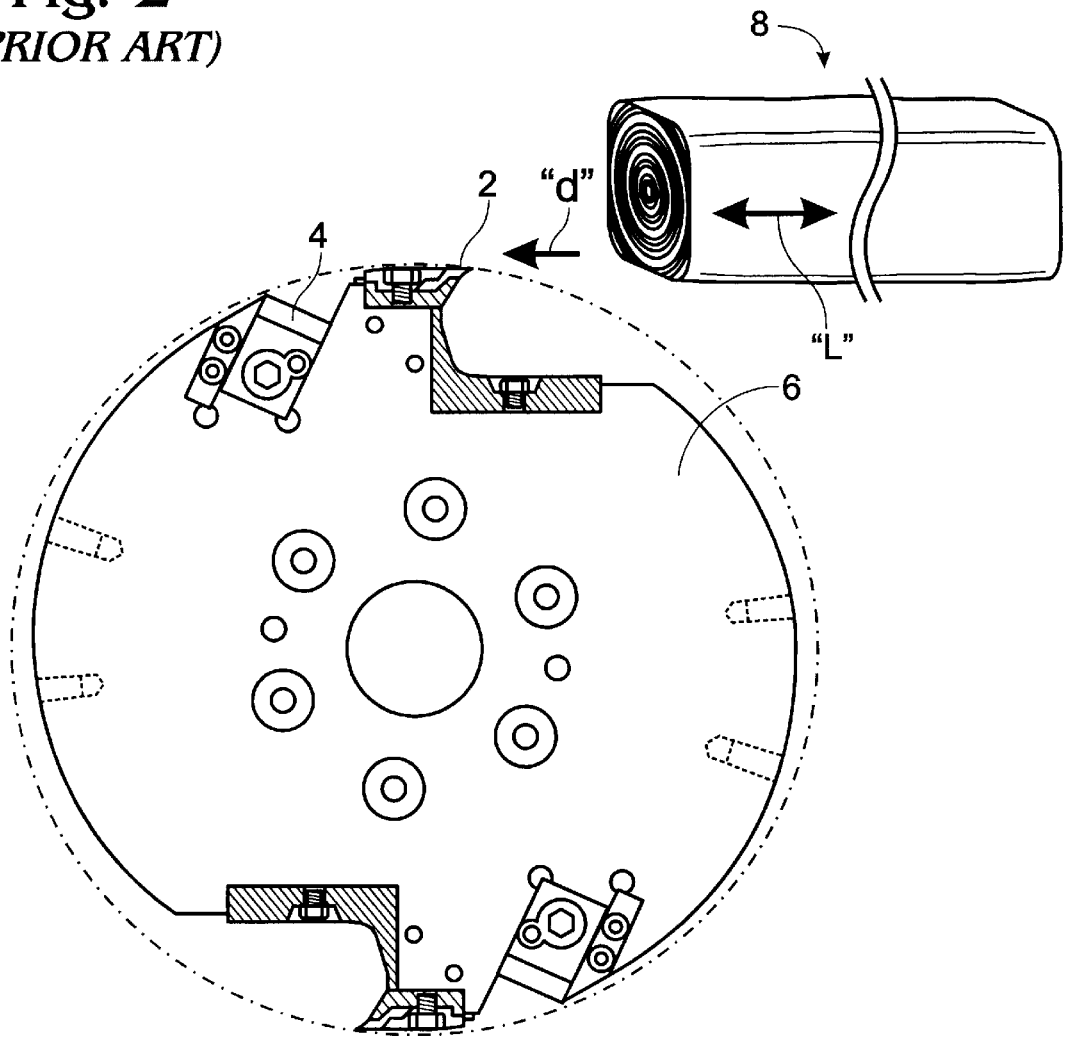
Fig. 2 (PRIOR ART)
FIG. 2 is a plan view of a first prior art profiling apparatus.

Referring to FIG. 3, a rotor 12 is provided with a desired number of mounting members 14, such as four. The rotor may be disc shaped or it may have some alternative configuration such as that shown. As shown in both FIGS. 3 and 4, the rotor rotates about an axis "R." As in FIG. 2, a slabbed log 8 having an elongate axis "L" is fed toward the rotor along a circumferential direction "d" which is represented in FIG. 4 and which is perpendicular to the plane of FIG. 5.

Each mounting member 14 includes two holders 16 and 18. Each holder is adapted to clamp an associated knife 17 and 19 to the mounting member. The knives may be any cutting implements including, for example, saw teeth. The mounting member is, in turn, adapted for mounting to the rotor 12. The identification of discrete parts such as the mounting member and rotor may be somewhat arbitrary since these parts could be combined into an integral unit and function identically for purposes of the present invention. However, it is often preferable to provide these components as individual parts that are adapted to be connected together with machine screws or bolts.

The holders 16 and 18 are adapted for clamping their respective knives to the mounting element and for releasing the knife to allow the knife to be removed therefrom. Any of a number of prior art holders may be employed. A particularly advantageous holder is that described in co-pending patent application Ser. No. 09/195,731, which is shaped to fit knives marketed by Key Knife, Inc., under the trademark KEYKNIFE.

Figure 5:
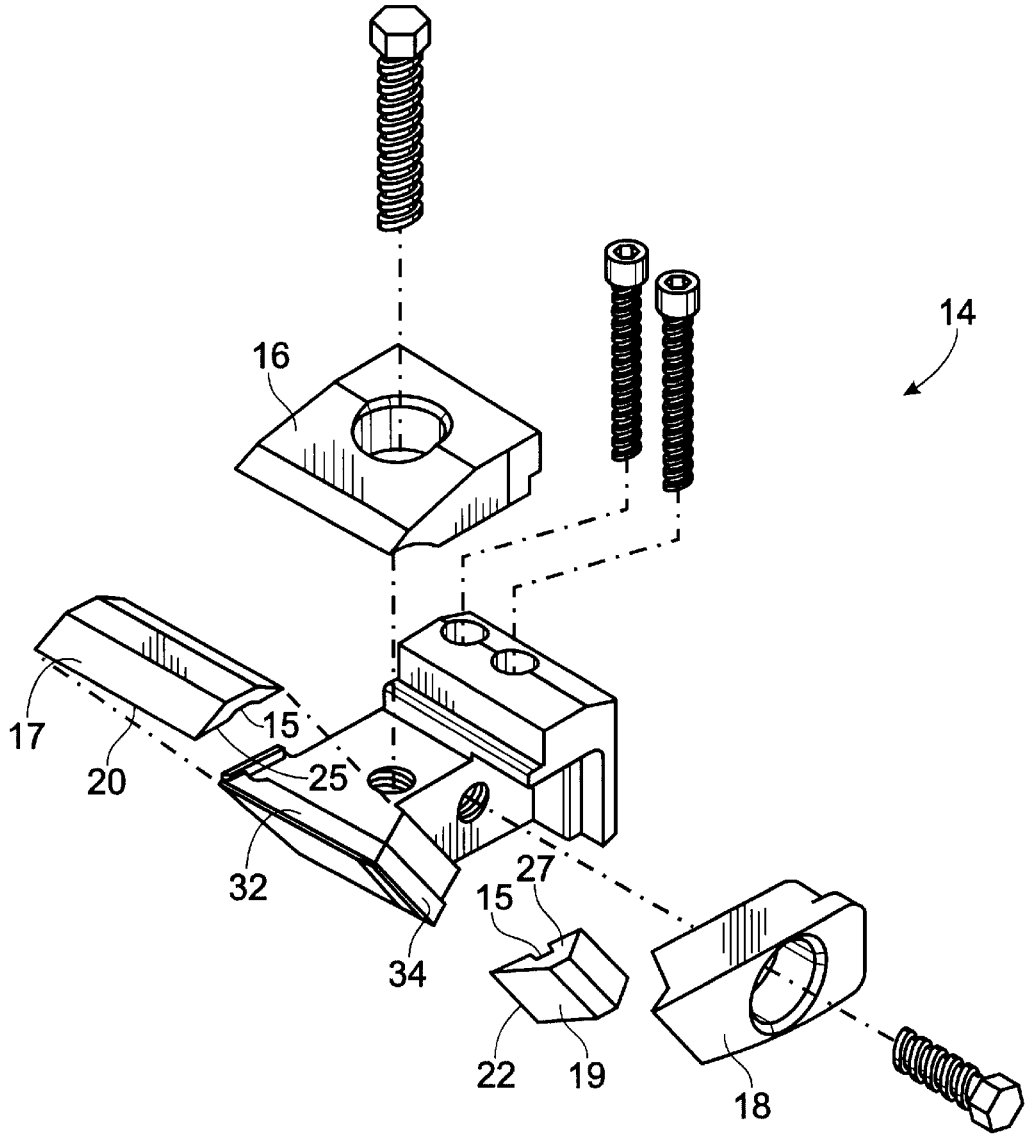
FIG. 5 is an exploded view of the preferred mounting member of FIG. 3.

FIG. 5 presents a more detailed view of a preferred mounting member 14 as shown in FIG. 3. The knives 17 and 19 have respective cutting edges 20 and 22. The knife 17 is mounted by the holder 16 to the mounting member 14 so that the cutting edge 20 extends parallel to the rotational axis "R" of the rotor. The knife 19 is mounted by the holder 18 to the mounting member so that the cutting edge 22 lies in a plane of rotation of the rotor. The cutting edges 20 and 22 are typically disposed to form a 90 degree angle therebetween, for cutting a square corner C.

Referring particularly to FIG. 5, the knives are preferably adapted so that a back side 27 of the knife 17 abuts a side surface 25 of the knife 19 to form a mitered corner. For this purpose, the side surface 25 of the knife 19 is angled obliquely with respect to the cutting edge 22, and for the side surface 25 of the knife 19 is angled obliquely with respect to the cutting edge 22, and for cutting opposite corners C, left and right handed versions of the angle and, therefore, the knife 19 may be provided.

The cutting edges define lines composed of a number of points. Cutting action by each knife creates respective surfaces, typically though not necessarily planes, as a result of the cutting edges progressing through the work as a result of relative movement there between. Similarly, cutting action resulting from a particular point on a cutting edge creates a line, typically though not necessarily straight, as a result of the relative movement. In the instant invention, the mounting member is configured so that at least one of the points on one of the cutting edges is proximate at least one of the points on the other of the cutting edges. Preferably, these points are end points "O" of the respective cutting edges and, preferably, these points abut one another, such as shown in FIG. 4.

Particularly, where the cutting edges are brought into proximate coincidence at their end points "O", i.e., their tips, it has been found that this coincidence is preferably no more than about ⅛" for notable minimization of surface irregularities such as "waviness" and feathers, with 1/16" being a more desirable outer limit for commercial practice. It has also been found that decreasing the chip size generally permits a larger separation between the points for purposes of minimizing waviness, but the generation of feathers is not substantially affected. Neither waviness nor the generation of feathers is substantially affected by the size of the knives.

While the aforementioned limits of proximity between the cutting edges are preferable, it is emphasized that the results obtained by employing the present method and apparatus at proximities greater than ⅛" remain superior to those obtained heretofore. This is because, as has been determined by the inventors of the present invention, the closer the cutting edges are brought into an intersecting coincidence, the smoother the aforementioned surfaces will be and the less the smoothness of the surfaces will be affected by wear in the apparatus. Known prior art cutting edges in log profiling apparatus have been disposed so that closest points thereon are, at best, about 1" apart, evidencing a lack of appreciation that closer proximities are desirable. Therefore, closest points on respective cutting edges of a log profiling apparatus may have a separation that is substantially less than, but yet approaches, 1" and still be sufficiently "proximate" one another to realize an advantage over the prior art in accord with the teachings herein.

In the preferred structure shown in FIG. 5, the knives 17 and 19 each include a slot 15, and the mounting member 14 includes corresponding tongues 32 and 34. The slots and tongues are adapted to mate with one another as shown in FIG. 5 for the knife 17.

It is to be recognized that, while a particular method and apparatus for profiling a log has been shown and described as preferred, other configurations could be utilized, in addition to configurations already mentioned, without departing from the principles of the invention. Moreover, there is no intention to limit the invention to use in profiling apparatus where there may be other applications involving similar considerations for which the present invention provides similar advantages.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

We claim:

1. In a profiler having first and second knives having respective cutting edges defining an angle therebetween, a rotatable mounting member that is adapted to mountably receive both the first and second knives so that each knife has at least one point on its respective cutting edge that is proximate at least one point that is on the cutting edge of the other knife, wherein at least one of the knives includes a slot, said slot being adapted to mate with a corresponding tongue in said mounting member.

2. The mounting member of claim 1, wherein said mounting member is further adapted to mountably receive the first and second knives so that respective ends of the cutting edges are proximate one another.

3. The mounting member of claim 1, wherein the mounting member is further adapted to mountably receive the first and second knives so that respective ends of the cutting edges abut one another.

4. A method for profiling a log or other elongate article, comprising the steps of:

providing a first knife having a cutting edge;

providing a second knife having a cutting edge;

disposing said cutting edge of said first knife and said cutting edge of said second knife so that said cutting edges form a non-zero angle therebetween and so that at least one point on said cutting edge of said first knife is proximate at least one point on said cutting edge of said second knife;

moving said first and said second cutting edges and the log or other elongate article relative to each other to cut two surfaces in the log or other elongate article with said first knife and said second knifer; and providing a slot in at least one of the knives, said slot being adapted to mate with a corresponding tongue in said mounting member.

5. The method of claim 4, wherein said step of disposing includes disposing said cutting edge of said first knife and said cutting edge of said second knife so that respective ends of said cutting edges are proximate one another.

6. The method of claim 4, wherein said step of disposing includes disposing said cutting edge of said first knife and said cutting edge of said second knife so that respective ends of said cutting edges abut one another.

* * * * *

UNITED STATES PATENT AND TRADEMARK OFFICE

CERTIFICATE OF CORRECTION

PATENT NO. : 6,058,992
DATED : May 9, 2000
INVENTOR(S) : Bradley R. Stager and John S. Luecke It is certified that error appears in the above-identified patent and that said Letters Patent is hereby corrected as shown below:

Column 4,
Line 63, change “knifer and” to -- knife and --.

Signed and Sealed this

Twenty-sixth Day of October, 2004

JON W. DUDAS
*Director of the United States Patent and Trademark Office*